United States Patent [19]

Otzen

[11] Patent Number: 4,462,415

[45] Date of Patent: Jul. 31, 1984

[54] PARTS CLEANER ADAPTED FOR SIMPLIFIED SERVICE

[75] Inventor: Karl G. Otzen, Barrington, Ill.

[73] Assignee: Safety-Kleen Corporation, Elgin, Ill.

[21] Appl. No.: 441,640

[22] Filed: Nov. 15, 1982

[51] Int. Cl.[3] ..... B08B 3/04

[52] U.S. Cl. ..... 134/111; 134/115 R

[58] Field of Search ..... 134/104, 109–111, 134/115 R

[56] References Cited

U.S. PATENT DOCUMENTS

| | | | |
|---|---|---|---|
| 3,522,814 | 8/1970 | Olson | 134/111 |
| 4,016,893 | 4/1977 | Scott | 134/115 R |
| 4,056,114 | 11/1977 | Boutillette | 134/104 |
| 4,105,342 | 8/1978 | Plourde | 134/111 X |

*Primary Examiner*—Robert L. Bleutge

*Attorney, Agent, or Firm*—James T. FitzGibbon

[57] ABSTRACT

An easy-to-service parts washer unit having separable components, including a cleaning fluid storage and transport receptacle, a sink unit and a fluid circulating unit. The receptacle is adapted to lie flat on a work bench or the like, and to lie beneath and support a sink disposed thereover. The fluid circulating unit includes a pump and motor, a filter, a dip tube which extends in use into the receptacle and a hose or the like portion which extends into the sink for directing fluid over parts to be washed. Preferably, the sink includes a closable safety cover, the movement of which is controlled by a fusible link. The lower surface of the sink and the upper surface of the receptacle when it is in position of use are contoured for mutual engagement and support, and the fluid circulating assembly includes a housing which is also held in place by contoured engagement portions. When it is desired to change the cleaning fluid, the sink, circulating assembly and receptacle are separated from each other and the receptacle openings serving as the pump, dip tube opening, and the drain opening respectively are closed by plugs and the receptacle is transported to a recycling center for exchange. Preferably, the sink is held to the receptacle by a removable lock which also serves as a drain screen and the circulating unit has a housing which are engaged by parts of the sink and thus held in place.

36 Claims, 21 Drawing Figures

50
44
48
48
42
62
54
32
22
46
36
35
52
56
30
20
28
38
40
136
128
82
134
122
132
34
120
88
126
116
122
114
86
124
112
110
24
92
118
96
94
90
106
102
104
108
84
98
150
142
152
158
162
148
166
156
144
154
146
164
138
166
26

PARTS CLEANER ADAPTED FOR SIMPLIFIED SERVICE

The present invention relates generally to so-called parts washers and, in particular, to parts cleaners, which are particularly adapted to be used by professional or semi-professional mechanics, as well as homeowners, farmers, ranchers, hobbyists, or other users whose activities do not always justify the use of a larger or more elaborate parts washer or from whom professional service is not conveniently available.

Parts washers of various kinds are known to those skilled in the art as having great utility for mechanics and others working in a variety of occupations, particularly those working in industrial plants, maintenance and repair services, and the like. At one time, the development of parts washers was based on an attempt to insure reasonable convenience in use and good cleaning action. Many garages, service stations and the like owned and used soak tanks, so-called hot tanks, or immersion type parts cleaners, usually of more or less elaborate configuration.

U.S. Pat. No. 3,522,814 described a new concept in parts washers insofar as it related to a parts washer construction which included, among other novel features, a construction particularly adapted to facilitate extremely rapid and simple machine service. An entire industry was then founded on the concept of a parts washer which was designed so that it could be economically and effectively serviced by route men with little, if any, specialized training. It was discovered that there was an enormous market among garage and service station owners, automobile dealers, and industrial plant operators for a parts washer which could be serviced safely and without disrupting operations, either by way of downtime or physically interfering with such operations.

The ideal parts washer is reliable, safe, quiet and effective in use, is free from environmental objections, and perhaps most importantly, can be serviced readily as just discussed. Now existing solvents, with or without special additives, are adequate to achieve good cleaning of most dirty, greasy, mechanical parts, with the result that the emphasis on parts cleaner design is not so much the ability of the unit to clean parts better than existing parts cleaners, but to have other features of construction which relate to safety, servicability, and convenience in use.

While the parts washer described and claim in U.S. Pat. No. 3,522,814 has achieved phenomenal success in commercial markets, there is still room for important developments in parts washers which are lower in cost, and which can be sold to the user and serviced by him personally, or with minimal inconvenience or outside help. It is anticipated that there are hundreds of thousands, if not millions, of individuals who could use a professional style and quality parts washer, but who do not need the large size of commercial models, and cannot justify their expense. By the same token, service organizations are sometimes reluctant to provide parts washers on a service only basis, if the service interval is so long that the investment in the machine cannot be recovered within a reasonable time. As a consequence of the foregoing, there has been a need for a parts washer which could be purchased by professional mechanics, including "moonlighters", the hobbyists, amateur mechanics, homeowners, farmers, ranchers or the like who desires to own a parts cleaner, but are not desirous of purchasing an expensive unit or executing a long term service contract calling for more frequent servicing then would reasonably be required by an occasional, rather than a regular, user of the unit.

In view of the failure of the prior art to provide a safe, low cost, parts washer, intended for purchase by occasional users, and adapted for self-service fluid changing it is an object of the present invention to provide an improved specialty parts cleaner.

Another object of the invention is to provide a modular type parts washer which can be purchased by the user and which may thereafter be serviced by him on an as needed basis with a minimum of effort and cost.

A further object is to provide a parts washer having a sink or washing compartment component adapted to cooperate in use with a solvent storage receptacle, which receptacle can serve as a solvent reservoir in use and also as a returnable container for the solvent on a deposit or outright purchase basis.

A still further object is to provide a parts washer having the operating convenience and safety features of a larger, professional style parts washer.

Yet another object is to provide a parts washer which can be made of economical materials using mass production techniques.

A still further object of the invention is to provide a parts washer that is readily transportable, thus being adaptable for check-out use from a tool crib or the like in an industrial environment, or for ready transportation to a temporary work site or the like.

Another object of the invention is to provide a parts washer which is adapted to be positioned for use on a work bench or countertop, but which can also be placed on a rack or the like for free-standing operation.

A further object is to provide a parts washer having a sink and safety covering component, a pump, filter and hose component, and a solvent storage transport receptacle with cooperates in use, but which are adapted to be readily separated for purposes of service, exchange at a retail outlet, or otherwise for solvent replacement and/or replenishment.

A still further object is to provide a solvent storage container which is adapted to receive and store solvent and also to act as a base or suport unit for an associated parts washing sink.

Yet another object is to provide a parts cleaner which includes a sink, and a pump and filter component which may be easily attached to, but readily removable from, an associated solvent storage and transport receptacle.

Another object is to provide a solvent storage receptacle which is readily adapted for storage, replenishment and display by a retailer and which preferably includes features such as easy portability, stackability, etc.

A further object is to provide a parts washer which can be made from durable materials, and which does not require exacting tolerances in manufacturing.

Yet another object is to provide a parts washer with a simple and reliable pump system, preferably including a readily replaceable filter.

An even further object of the invention is to provide a solvent storage receptacle, sink unit and pump and filter assembly which can be affixed to each other in use by simple and effective means adapted to provide an assembled article which is stable and rigid.

Another object of the present invention is to provide a parts washer system which includes a sink and storage receptacle adapted to prevent accumulation of solvent outside the storage area, where such solvent could create fire or explosion hazard.

A particular object is to provide a novel combination drain screen and fastener which serves to secure the sink to the storage receptacle, to act as a screen to prevent loss of small parts, and which also includes means defining alternate flow paths between the sink interior and the drain opening in the receptacle to further reduce the likelihood that the drain will be blocked, either intentionally or unintentionally.

A further object of the invention is to provide a parts washer in which the safety cover may be readily locked in place to prevent misuse or accidents.

A still further object of the invention is to provide a parts washer unti which includes a safety cover adapted to be closed in the event of solvent fire so as to extinguish such fire or prevent the spread thereof.

An even further object of the invention is to provide a parts washer which includes a storage and transport receptacle having means for storing receptacle closures during the time the parts washer is being used.

Another object of the invention is to provide a parts washer having an associated storage and transport receptacle or container which includes both drain openings and pump dip tube openings, as well as storage receptacles for the plugs, caps or covers used to close the drain and dip tube openings.

A still further object is to provide a multi-purpose receptacle which, depending upon its size, may include a carrying handle forming a part of either the short or long side of the receptacle, or which includes such handles on both the long and short sides thereof.

A further object is to provide a modular parts cleaner which can be serviced by the owner without special knowledge, training or tools, but which is equally able to be serviced by outside service personnel.

Another object of the invention is to provide a parts washer assembly which draws solvent from an area near the surface of the liquid, and which is accordingly responsive to a depletion in solvent by decrease in solvent flow, thus indicating the need for changing or replenishing the solvent.

The foregoing and other objects and advantages of the invention are achieved in practice by providing a parts washer having a combination solvent storage and transport receptacle adapted to support a parts cleaner sink or the like and to receive the same in snug relation thereover, with the unit further including a pump and filter unit adapted in sue to withdraw solvent from the receptacle and direct the solvent toward the parts received within the sink for cleaning under the control of an operator.

The invention also achieves its objects and advantages by providing a solvent container adapted to receive and transport solvent, and to be used as a support or base for an associated parts washing sink, with means being provided to removably fasten the container to the sink so that the sink and receptacle assembly may be manipulated as a unit.

The exact manner in which the foregoing objects and advantages of the invention are achieved in practice will become more clearly apparent when reference is made to the following detailed description of the various preferred embodiments of the invention, set forth by way of example and shown in the accompanying drawings, wherein like reference numbers indicate corresponding parts throughout the several figures.

DESCRIPTION OF THE PREFERRED EMBODIMENTS OF THE INVENTION

Before describing in detail, the preferred forms of the parts washer units of the invention, it will be understood that units of the invention have other uses than those specifically recited herein, and that certain of the components thereof may be made in various forms or embody constructions which differ from each other in detail.

Likewise, it will be understood that one feature of the invention is the ability of the unit to be stored in one of two different positions, and that the storage and transport container may be used as a sink base in one position and as a storage and transport receptacle in one of either of two other positions. Accordingly, unless otherwise clearly indicated by expression or context, the unit will be described in its position of use as a parts washer, with the "front" lying toward the user with the pump and filter unit lying on the left hand side of a user facing the unit, and with the storage and transport receptacle having, in position of use, as a sink base, a handle at the left side or at the front or rear.

In certain parts of the description hereof, the expression "solvent" is used to indicate a preferred cleaning fluid, or for purposes of brevity. However, the apparatus is inherently capable of working with true organic solvents, with aqueous systems, emulsions, or mixtures thereof. Accordingly, the word "solvent" is not intended, unless otherwise clearly indicated, to be limited to true solvents, and should be understood as being synonmous with "cleaning fluid" or "cleaning liquid".

Figure 1:
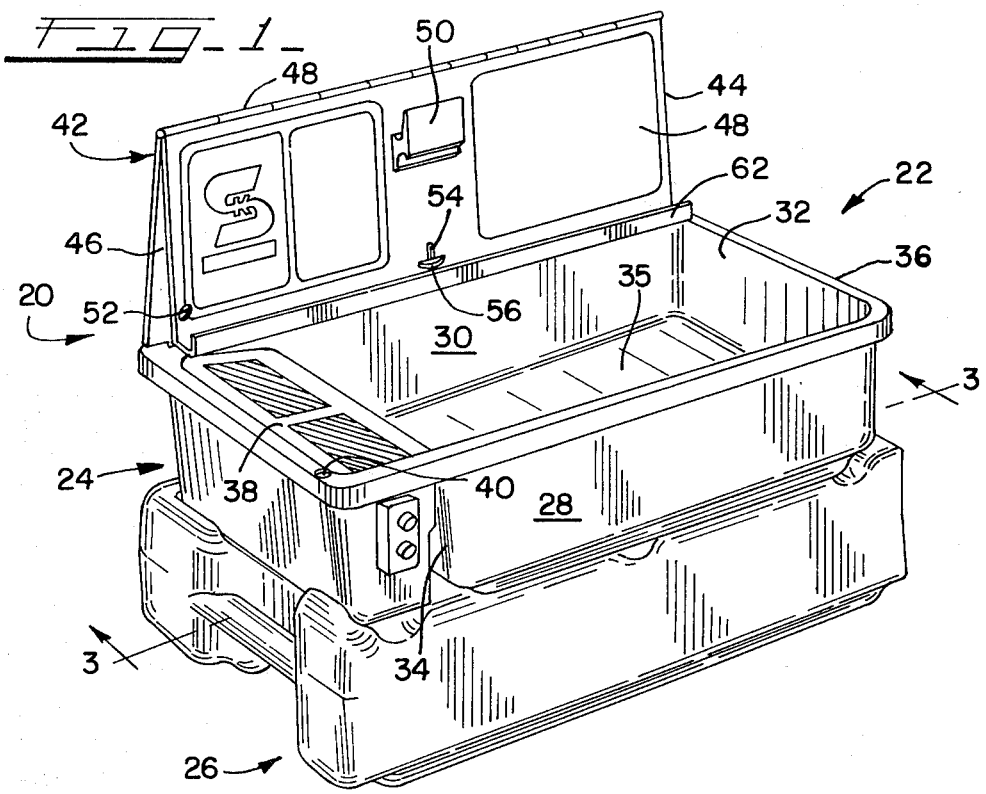
FIG. 1 is a perspective view showing the self-service parts washer of the invention, with the sink portion disposed atop and interfitted with the solvent receptacle in the position of use.

Referring now to the drawings in greater detail, FIG. 1 shows a self-service parts washer assembly generally designated 20 and shown to have three major components, a sink assembly 22, a pump and filter assembly 24 and a storage and transport receptacle or container 26.

Referring first to the sink assembly unit, this unit is shown to have principal elements of the sink assembly, including front and rear sink walls 28, 30 and a pair of opposed sink sidewalls 32, 34, a marginal flange unit 36 extending around the upper periphery of the sink, and a patterned or contoured, inclined drain board 38 for temporary storage of parts being washed. An opening 40 is provided in a portion of the flange 36 for receiving a lock unit referred to elsewhere herein; the flange 36 also provides a cooperating surface for receiving the safety cover and adds overall torsional stiffness to the sink assembly 22. A cover element generally designated 42 is provided, and is shown to include a front or label panel 44, and a rear panel 46, connected to each other by a piano hinge 48. The front portion 44 of the safety cover 42 includes one or more labels 48, a handle 50, and an opening 52 for cooperation with the lock receiving opening 40. The cover 42 also has a key slot 54 for receiving a fusible link 56, the construction and operation of which are referred to elsewhere herein.

Figure 11:
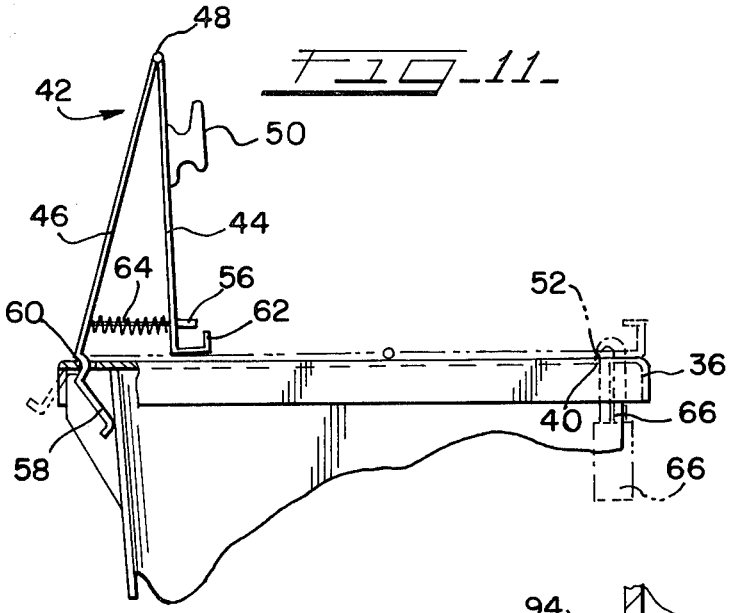
FIG. 11 is a fragmentary side elevational view showing the construction of the safety lid, the fusible link, and the locking mechanism for the folding safety cover.

Referring now to FIG. 11, it will be noted that there is a rear extension portion 58 of the rear cover panel 46 which extension 58 cooperates with slots 60 in the rear portion of the sink flange 36 to act as a rear panel hinge. FIG. 11 also shows a flange 62 forming a part of the front cover 44, as well as a spring 64 which is actuated in closing the cover 42 in the event of fire, in a manner to be described. FIG. 11 also shows, in phantom lines, the provision of a padlock 66 or the like, the bight 68 of which extends through the openings 40, 52 to secure the cover in a closed position against so as to prevent unauthorized use thereof.

Figure 2:
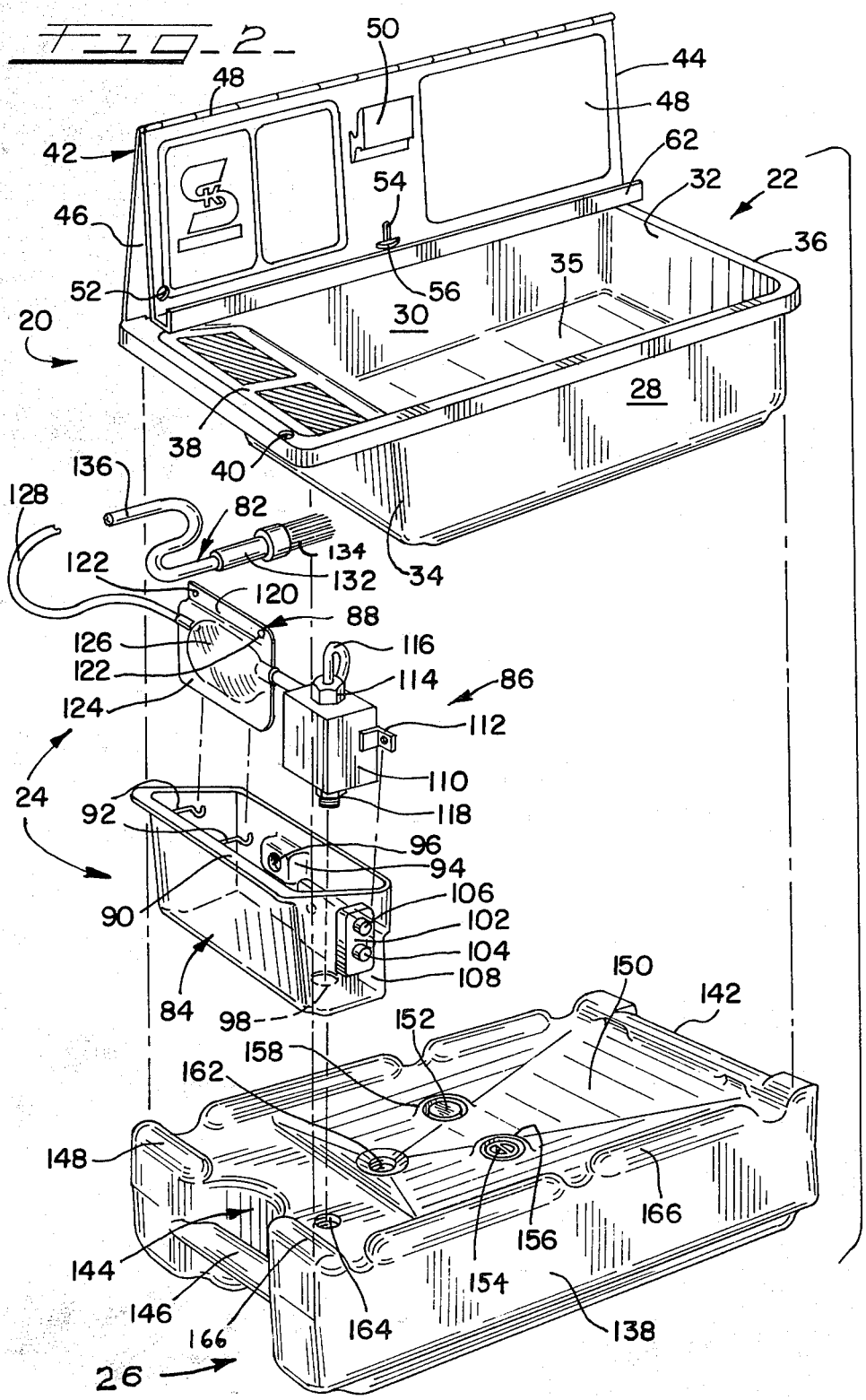
FIG. 2 is an exploded perspective view, showing the manner in which the sink unit, the pump and filter unit and the solvent storage and transport receptacle are assembled for use.
Figure 3:
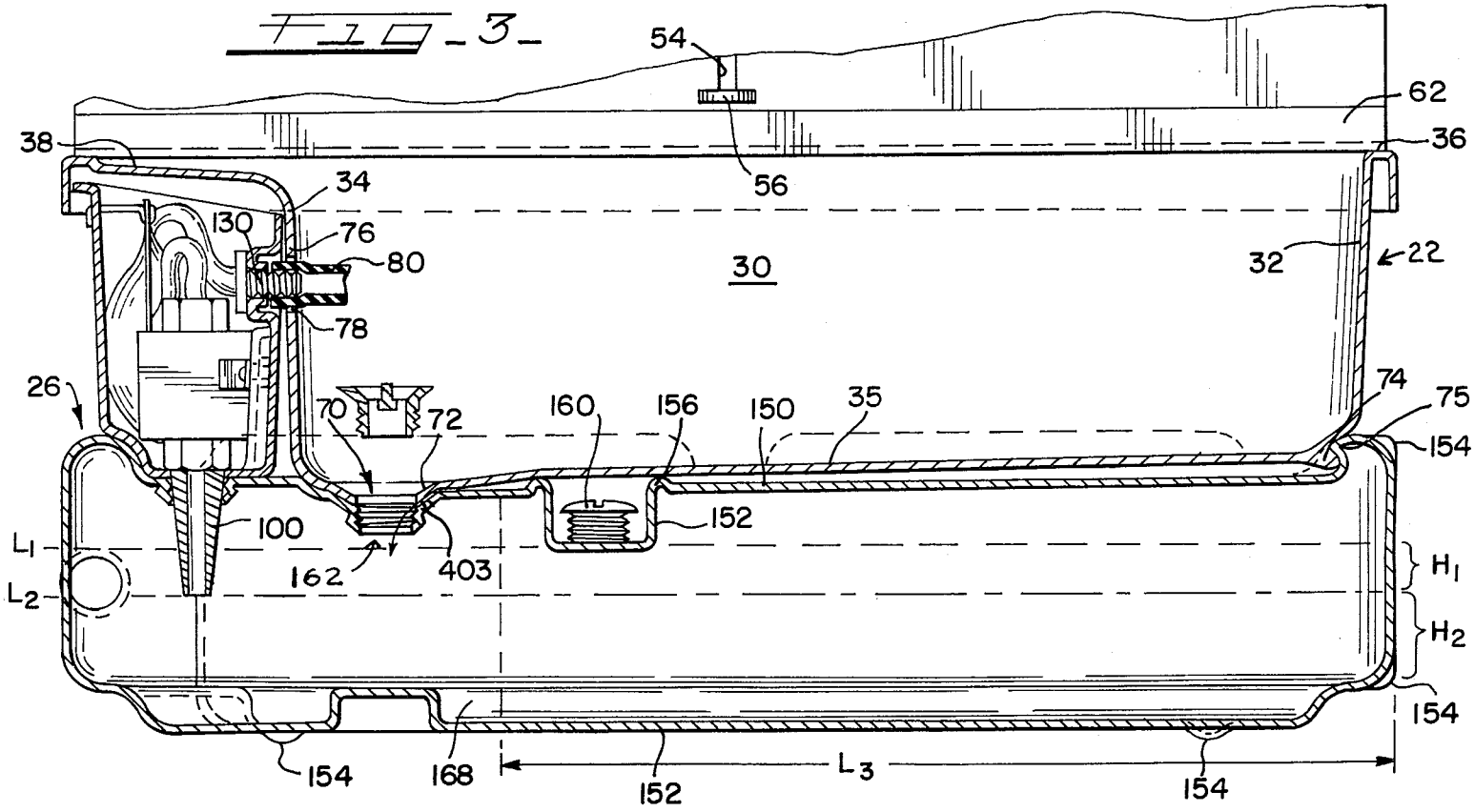
FIG. 3 is a vertical sectional view, with portions broken away, showing the disposition of the receptacle beneath the sink, and showing the pump and filter unit and the manner of affixing these components to one another.

Referring now to FIG. 3, certain other elements of the sink assembly are shown, including a lower drain port generally designated 70 and shown to be defined by a depressed margin 72, the details of which will be referred to elsewhere herein. The sink unit 22 also includes a locking heel portion 74, margins 76 in the sidewall 34 defining an opening 78 through which an end portion 80 of the fountain brush hose 82 (FIG. 2) may be received. As shown in FIG. 3, the drain board portion 38 of the sink 22 is adapted to overlie the pump and filter assembly 24.

Referring now in particular to FIG. 2, this pump and filter assembly 24 is in turn shown to include a plurality of principal components, namely, a housing means 84 in the form of an open tank or the like, a pump and motor assembly 86 and a hose and filter assembly 88. Referring first to the housing 84, it is shown to include a top marginal flange 90 defining its upper edge portion, a pair of filter bag support hooks 92, and contoured walls 94 defining a second housing 96 for a fitting which permits cleaning fluid to flow to the outlet hose and ultimately to the sink 22.

In addition, the housing 84 also includes an opening 98 in the bottom wall thereof through which the dip tube portion 100 (FIG. 3) of the pump 86 can pass. A control panel 102 having on and off switches 104, 106 is also associated in use with the front wall portion 108 of the pump and filter housing 84. This panel 102 preferably includes an integral line cord and plug (not shown) of conventional construction, and may be unitized with the pump and motor 86, is desired.

Figure 13:
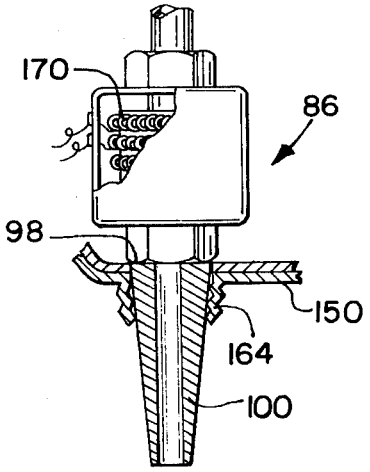
FIG. 13 is a front elevational view, with portions broken away, showing the construction of one form of pump made according to the invention.

Referring now to the pump and motor unit 86 which is shown in some detail in FIGS. 2, 3 and 13, the unit preferably includes its own housing 110 having means in the form of an apertured mounting bracket 112 for securing it to the housing 84. A fitting 114 is positioned atop the housing for securing the pump to the filter assembly 88 or to a first intermediate or pump-to-filter hose 116. A dip tube fitting 118 is provided on the bottom of the pump housing 110, for purposes which will be described later.

Referring now to the filter assembly 88, shown to be made of an impermeable but flexible polymeric film and to have a double thickness, top margin 120 with a pair of openings 122 therein so that the assembly 88 may be received over the support hooks 92. The filter itself comprises a plastic or like exterior bag section 124 having therein a non-woven fibrous or felt material 126, formed into a sack or the like and providing an inner, porous chamber for receiving fluid directed therein from the pump assembly 86. A second intermediate or filter-to passage hose 128 extends between the outlet side of the filter 88 and the fitting 130 which is received in the fitting housing 96.

As shown in FIG. 2, a flow-through or fountain brush assembly 82 is provided to assist the operator in washing parts disposed in the sink 22, with the brush 82 including a body portion 132 with an integral center fluid passage, a bristle portion 134, and a brush hose 136.

Referring now to a third major component of the unit, namely, the storage and transport receptacle 26, this unit is shown in FIGS. 2–7, to include a plurality of principal elements, namely, a front wall 138, a rear wall 140, a right hand side wall 142, and a contoured left hand side wall 144, one portion of which includes a tubular handle 146 extending between a pair of chamber ends 148. In use, as a storage or transport receptacle, the side wall 142 will become the bottom wall, the walls 138, 140 will extend vertically, and the handle 146 will lie on the top of the container.

Figure 4:
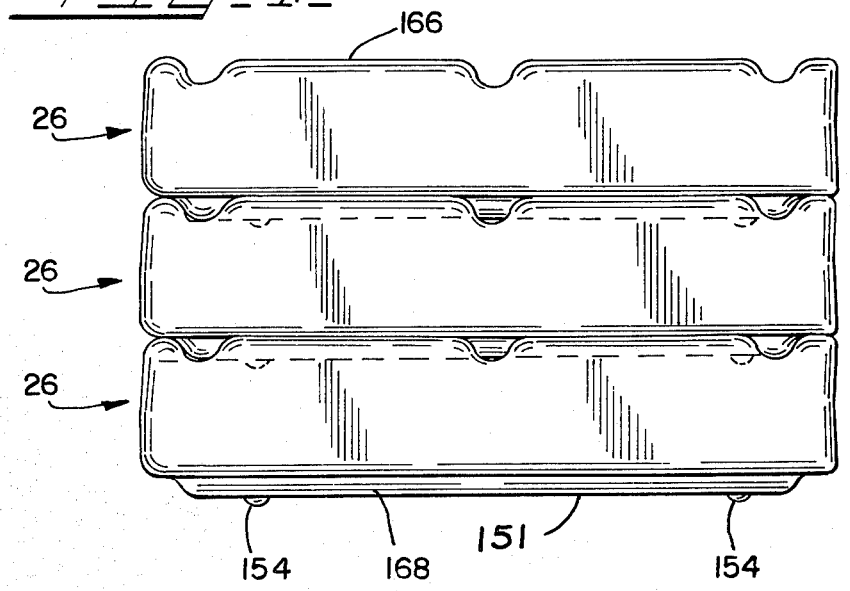
FIG. 4 is a front elevational view of a plurality of refillable solvent storage and transport containers showing them in stacked relation, one upon the other.

Referring again to FIGS. 2–7, the unit also is shown to include a contoured top wall 150, a contoured bottom wall 151 and a plurality of bosses or "feet" 154 which serve to stabilize the position of the container whether it is in the laid down or upright position. The container wall surface 150 includes a pair of wells 152, 154, each defined in part by raised upper surfaces 156, 158, and each being adapted to receive for storage therein a threaded plug 160 (FIG. 3). The receptable also includes a drain opening 162, and a pump stem receiving opening 164. The contour of the panel 150 is arranged so that the opening 162 forms the lowest point on the surface 150. The remaining portions of the container 26 are formed as shown and include the bosses 166 spaced about the periphery of the container and adapted to interfit with their counterpart recesses 168 on the lower surface of the unit so as to permit the receptacles to be stacked atop one another as shown in FIG. 4.

Referring now to FIG. 13, a preferred form of pump 86 is shown to include a tapered dip tube portion 100 and to include windings 170 or the like adapted when energized to actuate a core (not shown) of a solenoid for intermittent vertical reciprocating motion, and this to act as a fluid pump. Such units are well known to those skilled in the art and are commercially available.

Upper portions of the dip tube 100 are a press fit into the opening 164 in the top wall 150 of the container 26 and the uppermost portions of the tube 100 pass through and snugly engage the bottom wall opening 98 in the lower portion of the housing 84.

Figure 14:
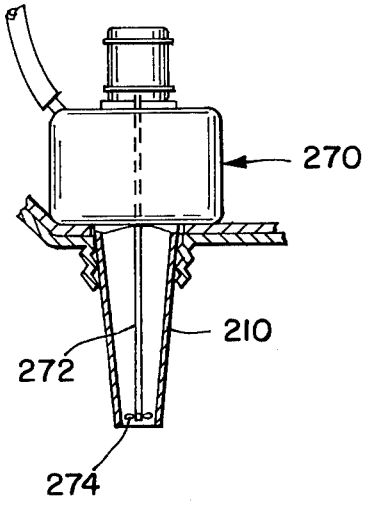
FIG. 14 is a front elevational view, with portions broken away, of another form of pump unit which is useful with the invention.

FIG. 14 shows an alternate form of pump 286 having a dip tube 210 and a motor 270 adapted to rotate a shaft 272 having an impeller 274 at the bottom thereof. In this form, the motor provides a rotary rather than a reciprocating action; the outer edges of the propeller or impeller are spaced closely apart from the lower dip tube opening. In use, this unit operates as a force pump not requiring a vacuum for operation.

Figure 15:
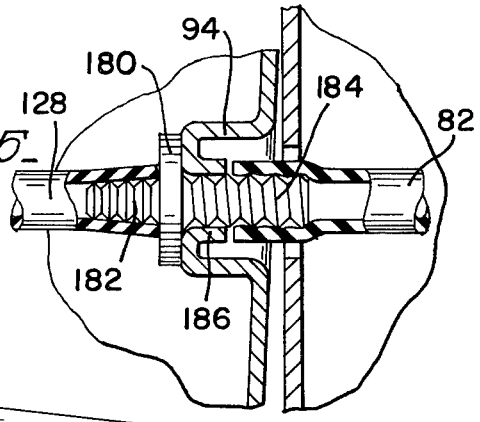
FIG. 15 is an enlarged fragmentary vertical sectional view, with portions broken away, showing the connection between the filter outlet hose and the fountain brush hose.

Referring now to FIG. 15, details of the fitting 180 received in the housing 94 are shown; the fitting 180 includes a body portion having contoured male ends 182, 184 extending outwardly therefrom in either direction. The fountain brush base 82 fits over one such end 184 whereas the second intermediate hose 128 extends over the other end 182. The portion 184 is snugly received in a sleeve portion 186, of the housing 94.

Figure 17:
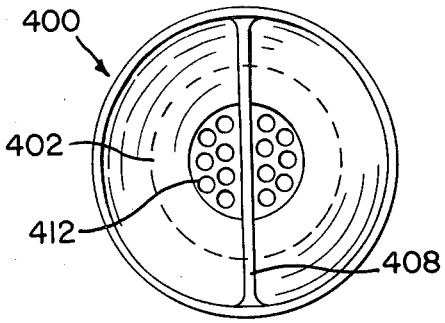
FIG. 17 is a top plan view of a preferred form of combination strainer and connector mode in accordance with the invention.
Figure 18:
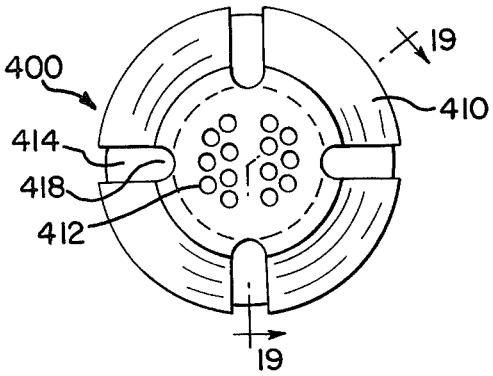
FIG. 18 is a bottom view of the combination unit of FIG. 17.
Figure 19:
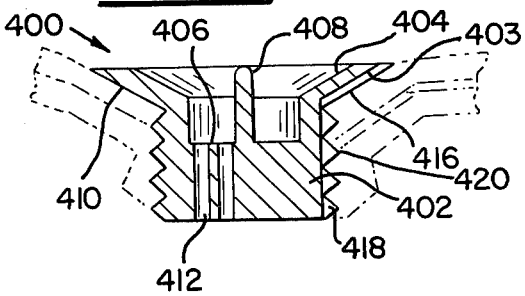
FIG. 19 is a vertical sectional view of the combination unit of FIG. 18, taken along lines 19—19 thereof.

Referring now to FIGS. 17–19, details of a preferred form of combination strainer and connector 400 (see also FIG. 3) are shown. This unit includes a body portion 402 having an enlarged diameter flange portion 403 with a frusto-conical upper surface 404 extending downwardly into a flat center surface portion 406. A handle 408 adapted to be engaged by the fingers spans most of the width of the top of the unit 400, and provides sufficient leverage to enable the unit to be tightly screwed by hand into the threads on the interior of the opening 162. A shoulder portion 410 is adapted to engage the margins 72 defining the sink opening 70. A plurality of axially (vertically in use) extending drain holes 412 are provided for cleaning fluid.

Figure 5:
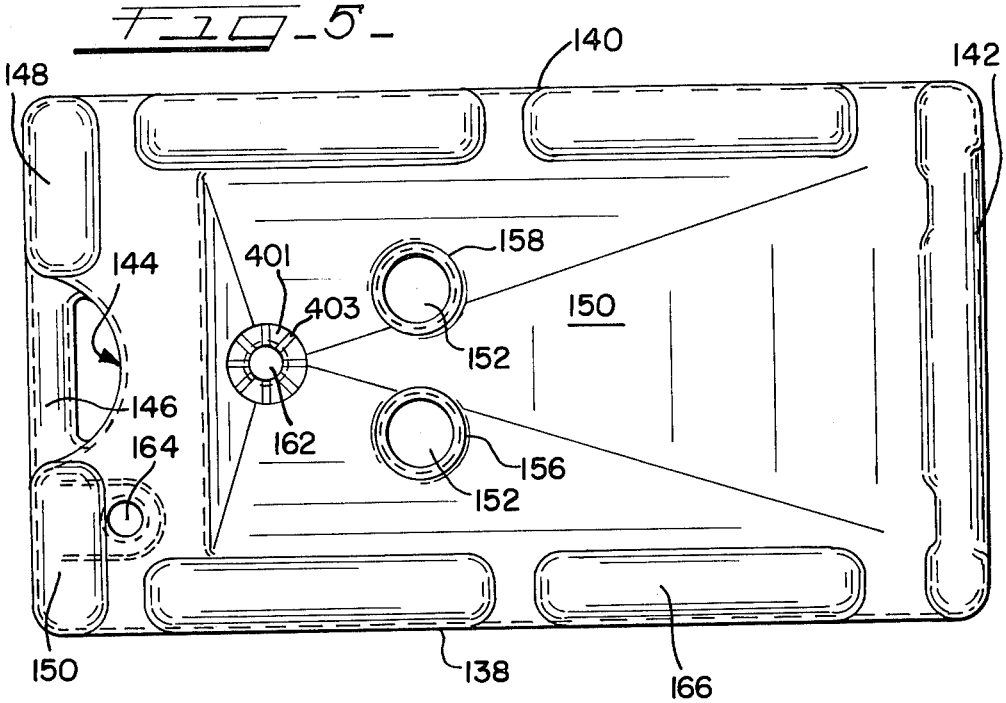
FIG. 5 is a top plan view of the storage and transport receptacle when it is laid flat in position of use.
Figure 6:
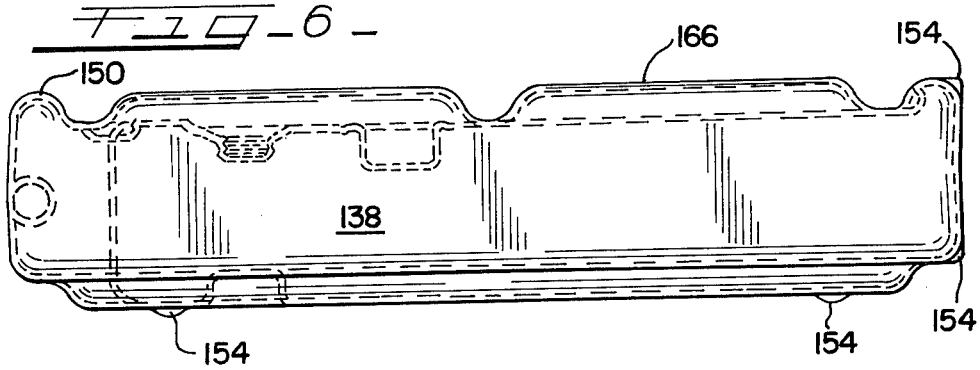
FIG. 6 is a front elevational view of the receptacle of FIG. 5.
Figure 7:
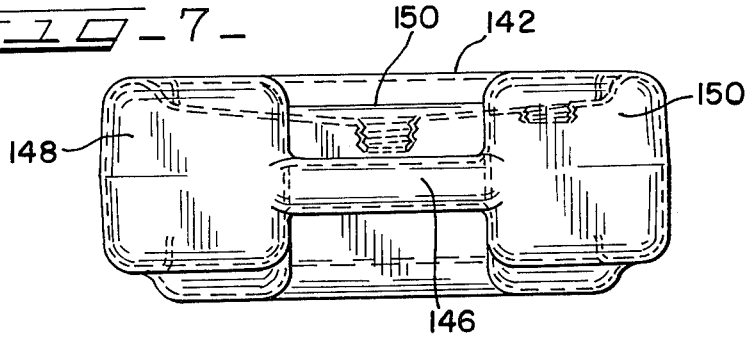
FIG. 7 is a side elevational view of the receptacle of FIGS. 5 and 6.

Referring specifically to FIGS. 18 and 19, a safety feature is shown to reside in the provision of inwardly and downwardly extending drain slots 414 on the underside 416 of the shoulder 410. These slots terminate at their inner diameters in passages 418 extending downwardly and lying radially inwardly of the threads 420. Consequently, in use, when the shoulder 410 engages the margins 72 of the sink, the slots 414 still provide a passage which combine with the vertical passages 419 to define a fluid flow path shown by the arrows in FIG. 19. Thus, blocking the sink drain port 70, particularly unintentionally, is difficult. Moreover, an additional safety factor resides in the provision of the axial exterior passages 418; this is because fluid accumulating in the well 150 of the receptacle can drain from the area beneath the sink into the interior of the receptacle 26. Thus, the combination strainer and connector or lock 400 provides for drainage from both of these areas. To facilitate drainage of the well 150 when the lower surfaces of the margin 72 are positioned as shown in FIG. 3, the margins 401 surrounding the opening 162 preferably also include depressed channels 403 (FIG. 5).

Figure 20:
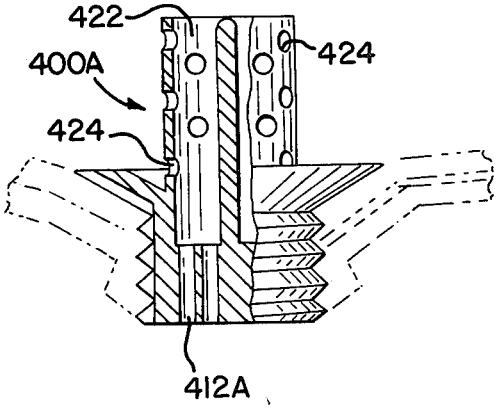
FIG. 20 is an elevational view, partially in section, of a further modified form of strainer-connector made according to the invention.

Referring now to FIG. 20, a combination strainer unit 400A similar to that shown in FIGS. 17–19 is provided, except that a perforated standpipe generally designated 422 is provided. In this construction, standpipe passages 424 permit draining of fluid into the area just above the inlet to the openings 412A. In Example 20, the handle 408 is raised so as to be accessible; other gripping means such as wings or the like (not shown) for the threaded member 400A may also be provided exteriorly of the standpipe 422, if desired.

Figure 21:
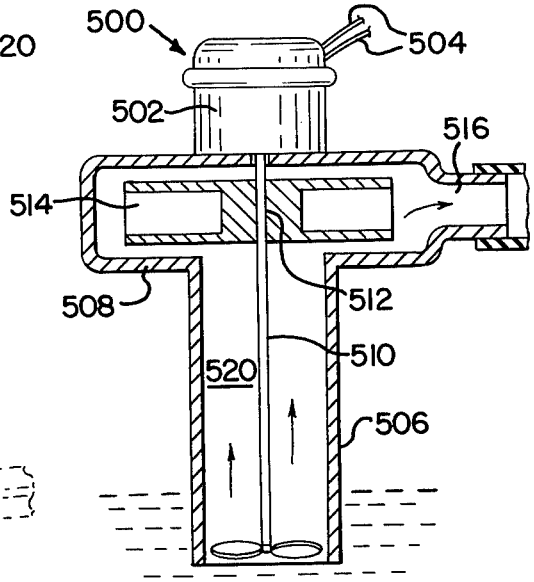
FIG. 21 is a side elevational view, with portions in section, and partly diagrammatic in character, showing a still further form of combination pump useful with the parts washer of the invention.

Referring now to FIG. 21, an alternate form of pump and motor generally designated 500 is shown to include a suitable motor 502 having connector wires 504. In this unit, a dip tube 506 extends downwardly from an impeller housing 508 disposed beneath the motor 502. A drive shaft 510 likewise extends downwardly from the motor 502 and serves as the center portion or axle 512 of an upper, bladed impeller 514 which operates centrifugally to pump fluid, as shown by the arrows, around the chamber 508 and through the outlet 516. The same shaft 510 extends downwardly inside the dip tube 506, and has its end portion attached to a propeller 518 or the like. In operation, the same motor drives the lower propeller, filling the interior 520 of the dip tube 506 with fluid; when the fluid height reaches that of the chamber 508, the impeller 514 engages the fluid and pumps it from the outlet 516, and thence to the brush or the like.

Figure 16:
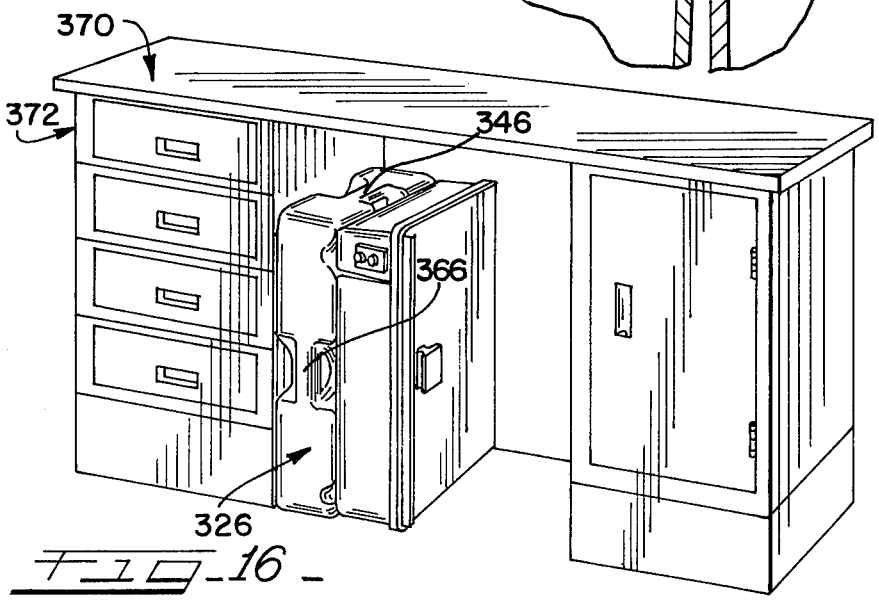
FIG. 16 is a perspective view of the sink assembly, associated with an alternate form of solvent storage and transport receptacle, made according to the invention.
Figure 12:
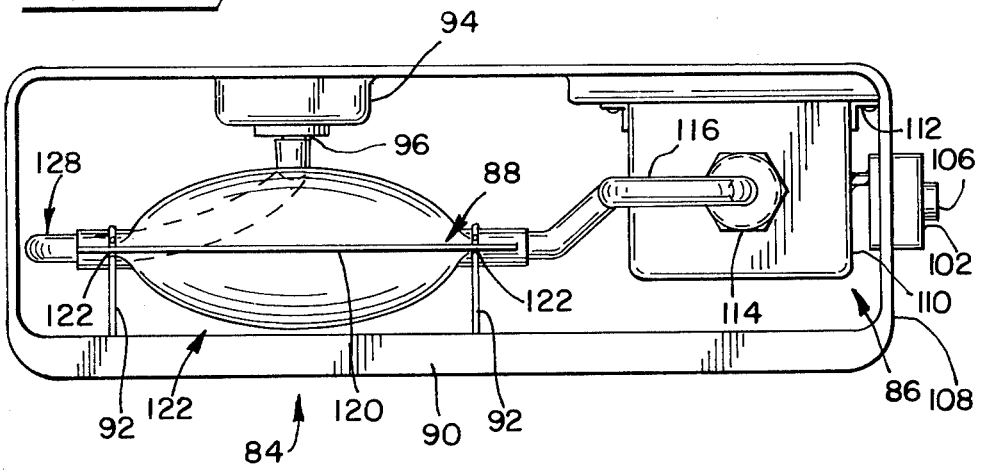
FIG. 12 is a top plan view of the pump and filter assembly of the invention, showing the same in position of use.

Referring now to FIG. 16, a modified embodiment of the invention is shown, and there is also shown the manner in which the cleaner may be positioned for storage or the like. In FIG. 16, a modified form of storage and transport receptacle 326 is shown. This unit is similar to its counterpart 26, except that it includes, in addition to the primary handle unit 346, an auxiliary side handle 366. This illustrates that, in the case of larger sized units, it may be desirable to position the carrying handle 366 on the long side of the receptacle 326 rather than on the shorter side as shown at 346. In some cases, it may be desirable or permissible to have handles in both of these locations.

By way of explanation, as the parts washer becomes larger in size, the height, when standing, of the receptacle 326 becomes larger. Handled containers greater than about twenty to twenty-four inches high are difficult to be carried by hand because their lower edges are close to or in contact with the ground. Accordingly, as the unit becomes bigger, it may be desirable to position the handle on the long edge. Thus, in the case of a unit which is eighteen to twenty-one inches deep in position of use and twenty-four inches wide, the handle may be positioned as shown at 346 in FIG. 16. However, as the unit approaches the size of thirty or more inches in length, it would be desirable to position the handle at 366. FIG. 16 also shows that for storage purposes, it is possible to position the bench top cleaner in an interfitting relation with the solvent storage and transport receptacle without loss of solvent; this is because the openings in the container are positioned high enough that the fluid level in the container lies well below them. This position is safe and the unit is shown with the cover closed and locked. When it is desired to use the unit, all three principal assemblies may be positioned as a unit on the top surface 370 of the work bench 372.

Referring now to the use of the parts washer unit 20, it will be assumed that a user has purchased the assembly 20 and wishes to operate it for the first time. Further assuming that the receptacle 26 is filled with solvent to the desired level (but not completely full), the parts cleaner is readily set up for use. First, the solvent receptacle is positioned as shown in FIG. 2 and the plugs 160 are removed from their associated openings 162, 164 and placed in the wells or pockets 152. Next, the pump and filter assembly 24 is positioned as shown in FIG. 3 with the dip tube 100 which extends through the opening 98 in the housing 84 being press fit into the opening 164. This secures the pump and filter assembly 24 in place. Then the sink and cover assembly 22 is positioned with the heel 74 being inserted first, as shown in FIG. 3, into itnerfitting relationship with the overlying lip 75 formed on the lower surface of the receptacle 26. The sink and cover assembly 22 is then further lowered into position so that the opening 70 in the bottom wall 35 of the sink 22 registers with the opening 162 in the container 26. At this point, the combination strainer and connector 400 is positioned in registry with the openings 70, 162, and then inserted and screwed into place by hand. This, in combination with the heel lock 74 just described, snugly holds the entire assembly together. Then, as shown in FIG. 3, inner end of the fountain brush hose 82 is forced over the fitting 184 (FIG. 15).

Assuming the cover 42 to be unlocked, the two panels 44, 46 are pushed to the position shown in FIG. 11 by use of the handle 50. Thereupon, the fusible link 56 is placed in a vertical alignment and slipped from the rear through the slot 54, after which it is rotated to a horizontal position as shown in FIGS. 1 and 11, thereby locking the cover open.

The power cord (not shown) may then be plugged in, and an appropriate button 102 pressed to energize the pump unit 86. Thereupon, the solvent or other clenaing fluid is drawn from the receptacle 26 pumped through the hose 116 and the filter bag 122, being then passed through the hose 128 and ultimately through the hose 82 to the fountain brush 132.

In use, and referring now to FIG. 3, the size and shape of the container 26 are arranged so that the initial fluid level in the container when it is horizontal is that illustrated in level L-1. When the container is placed verticlaly, this level will be below the outlets, typically at the height indicated as L-3 in FIG. 3. The length of the dip tube tube 100 is arranged such that when the solvent level falls below L-2 in FIG. 3, fluid flow will be intermittent or will be reduced or cut off alltogether. Thus, the unit is customarily operated between solvent levels L-1 and L-2, and when the solvent becomes excessively dirty or fails to flow, replacement is indicated.

At this point, the unit is unplugged and it may be disassembled in the reverse order of the assembly steps just referred to, with the plugs 160 being removed from their storage wells and inserted in the openings 162, 164. At this point, the container may be safetly stored and/or transported to a retail outlet, recycling center or the like. Typically, the container for which a deposit was originally paid, is returned, and a new, filled container is provided.

Figure 8:
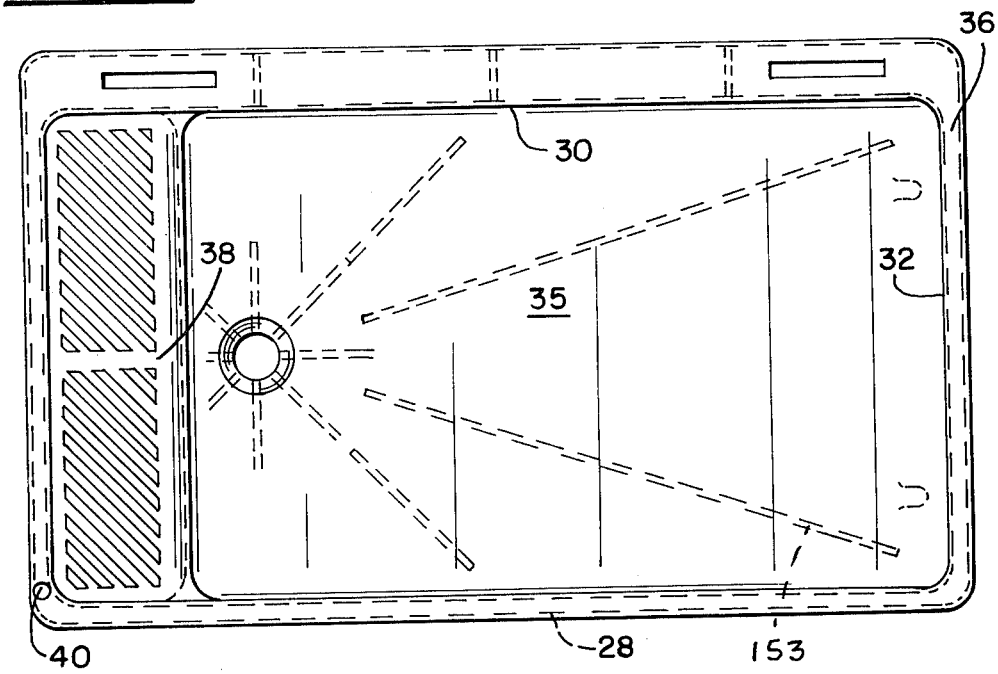
FIG. 8 is a top plan view of one form of sink unit made according to the invention.
Figure 9:
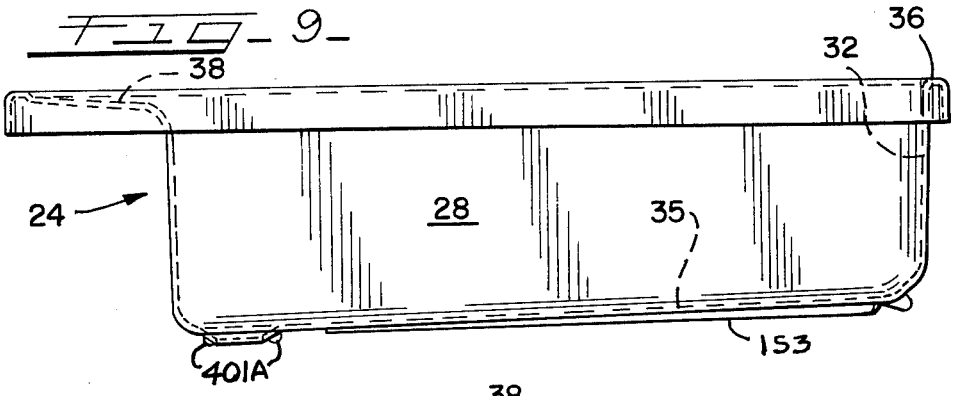
FIG. 9 is a front elevational view of the sink unit of FIG. 8.

Referring now to other features of the invention, it will be noted that the arrangement of the container 26 is such that leaks will be minimized, but if present, that they be be confined to areas served by drain openings. Thus, solvent will not accumulate outside the container 26. The provision of the raised edges 156 around the wells 152 insures that fluid will not accumulate in the wells, but will drain downwardly around them and into the opening 162. The sink 22 is kept spaced slightly above and apart from the receptacle surface 150 by the provision of ribs 153 (FIGS. 8 and 9). The fusible link 56 acts as a safety precaution in case of fire. If a fire breaks out in the sink 22, the link 56 melts, premitting the front panel 44 to move forward. The spring 64 urges the cover to the right as shown in FIG. 11, with a strong action, permitting the cover to lie flat (phantom line position of FIG. 11) to extinguish or contain a fire.

Referring now to other desirable features of the invention, the location of the sink drain opening and the pump dip tube openign in the same general area of the receptacle insures that the plugs for these openings need not hold a static head of fluid, but need retain only vapor. The positioning of the filter by the simple hook and eye mounting method, in combination with the pull-off/push-on hoses cooperating with the fittings respectively in the housing for the pump and motor on the one hand and the fitting for the brush hose on the other hand, provide easy filter replacement not requiring tools.

Referring again to the filter bag in the preferred embodiment, both the inlet and the outlet thereof lie at or near the top of the filter. Consequently, once the filter bag is initially filled, fluid will flow from the hose almost immediately upon subsequently actuation of the machine. That is, the filter bag will not be required to be refilled after every operating cycle.

In the alternative, if emphasis were placed on draining the filter after each use, the inlet would be placed near the bottom of the bag and the outlet near the top; ad a further alternative, a bypass arrangement may be provided whereby 90–95% of the fluid, for example, could be pumped through the filter with the remainder continually draining back into the sump. Thus, while the pump operates almost all of the fluid would be directed through the brush, but a small portion would return to the sump; then when the pump is shut off, the fluid accumulated in the filter bag will gradually drain into the sump so that fluid is not stored in the filter over an extended period of time. With the embodiment shown, however, if such storage of fluid in the filter is considered undesirable, the user can merely elevate the bag or squeeze it until most or all of the solvent has been removed therefrom.

Because of the design of the unit, particularly with the form of pump shown in FIG. 14, the unit is adaptable for use with organic solvents or with aqueous systems using detergents. The unit is also adaptable for use wherein two mutually immiscible liquids are provided. While a slotted head and threads have been shown to be provided in the plug 160, it is anticipated that these might be press fit or otherwise arranged to be removably receivable in the openings provided. These plugs may desirably be made of a plastic material or an appropriate elastomer.

An important feature of the invention is its low acquisition and operating cost potential. Therefore, while all of the components may be made from metal if fire resistance is of paramount importance, the receptacles are preferably made from synthetic plastic material such as polyethylene, polypropylene or the like. The illustrated examples show a container which is adapted to be made by blow molding, which is a very low cost mass production technique. The sink and motor housing components are preferably made from a material which can be thermoformed or cold drawn. Thus, these elements may be made from emtal such as steel or aluminum, or from a plastic material such as acrylonitrile-butadiene-styrene ("ABS"). Because of its requirement to provide fire resistance, the cover unit and its associated movement control assembly are preferably made from metal. A drain board area may be embossed as shown or may include one or more panels of rough-textured materials affixed by laminating or the like. The hose for the fountain brush is preferably rubber, but may be made from a plastic material. The filter bag hoses are preferably made from solvent resistant plastic to provide low cost.

In use, the parts washer provides most or all of the operational features of a larger, professional style parts washer. Hence, it is functionally suitable for use by professional mechanics who are both "moonlighting" or for use in shops not desiring expensive and sophisticated equipment. The parts washer of the present invention is particularly useful by farmers or ranchers whose mechanical and repair operations may be carried in areas remote from access to parts washer service route men. Thus, by reason of the particular design of the storage and transport receptacle, a farmer or rancher can obtain several more containers of solvent for use at a retail outlet or recycling center, retaining one or more reserve units to be placed in service from time to time. Because of the size and shape of the containers, they are easy to transport and exchange, unlike large drums, barrels, or other solvent containers which are handled by route men having trucks specially equipped for transporting such containers.

The transportability of the unit also enhances its desirability for use by traveling workers, such as maintenance crews involved in repairing earthmoving equipment, pipelines, crews, etc. For such people, the fact that the unit can be locked, stored securely and transported with ease is very appealing.

Referring now to other modifications and/or features which may be desirable in one or more models of parts washers falling within the scope of the invention, it is possible to obtain pump and motor assemblies wherein not only the motor itself, but also the switch and cord are potted with resin so as to form a single integral unit. This permits use of materials of lower dielectric strength and may reduce shock and fire hazards. In some cases, power supplies may be provided, making low voltage operation possible.

Figure 10:
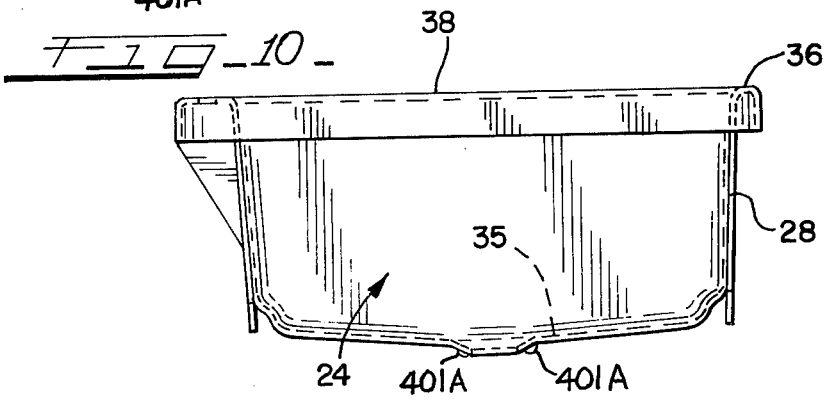
FIG. 10 is an end elevational view of the sink unit of FIGS. 8 and 9.

Inasmuch as it is desired to drain the upper or opposed or contoured surface of the receptacle, such as by providing channels 403 at the surface 401 defining the opening 162, this drainage may be accomplished by alternate means. Thus, referring to FIGS. 5, 9 and 10, for example, small bosses 401A may be provided on the lower side of the margins defining the sink drain opening. This method, or the method of cutting channels in the lower surface of the sink drain margins serve to provide a space between the upper receptacle surface and the bottom exterior surface of the sink to insure that fluid will not accumulate in the receptacle even where the sink and the receptacle are held together by a plug shown in FIGS. 17–19 or in FIG. 20. In these illustrations, channels are shown in phantom lines for this purpose and it will be understood that bosses 401A might be provided with equal effect. If channels such as those shown in 403 in FIG. 5 are provided, then the sealing plug should be made large enough to insure a fluid tight fit.

In FIG. 11, for example, a compression spring is shown as urging the bifold type top cover to a closed position. A torsion type spring associated with a piano hinge 48 or other equivalent means could also provide this function.

The parts washer of the invention will thus be seen to provide a unit which is virtually the performance equivalent of larger and more expensive units, but which is easy enough to service that it is ideally adapted for self-service, which is compatible with widespread retaining operations, and which further requires minimum expense of purchase and maintenance.

It will thus be seen that the present invention provides a novel self-service parts washer having a number of advantages and characteristics, including those pointed out above and others which are inherent in the invention. A preferred embodiment of the invention having been described by way of illustration, it is anticipated that changes and modifications of the described self-service parts washer will occur to those skilled in the art, and that such changes and modifications may be made without departing from the spirit of the invention or the scope of the appended claims.

I claim:

1. A readily serviceable, storable and transportable parts washer unit comprising, in combination, a storage and transport receptacle for cleaning fluid, a sink portion, and a cleaning fluid circulation system, said receptacle being a closable container having one portion thereof adapted to lie adjacent and be supported by a generally flat working surface and having an oppositely directed portion contoured so as to receive and locate in nested relation a cooperating portion of said sink, said receptacle further including first and second openings adapted respectively to permit washing fluid to drain into said receptacle and to receive a dip tube portion of said fluid circulating system for permitting withdrawal of said fluid from said receptacle, said sink including side and bottom walls defining a principal portion adapted to receive parts to be washed, and being of at least partially complementary shape with respect to said contoured portion of said receptacle so as to be received therein in nested relation, a drain opening in said bottom sink wall, said fluid circulating system including a dip tube, and a pump and motor adapted to draw fluid through said dip tube and to direct said fluid toward the parts to be washed, at least one of said sink and said fluid circulating system having means for directing solvent from said pump to a discharge outlet disposable within said sink, and means for releasably interlocking said sink to said container in nested relation and for removably positioning and holding said fluid circulation system such that said dip tube extends into said second receptacle opening.

2. A parts washer unit as defined in claim 1 wherein said sink portion further includes a safety cover unit, said safety cover unit comprising first and second relatively movable pieces, one of said cover pieces being hingedly attached to the other, and the other being permeable filter element in bag form, said element having a single opening therein communicating with said fluid inlet in said filter assembly.

19. A fluid circulating system as defined in claim 15 wherein said housing element including a fluid outlet opening therein, said outlet opening including a fitting having inlet and outlet ends and being adapted to receive hoses in removable relation to each of said ends, to facilitate fluid passage to said sidewall.

20. A fluid circulating system as defined in claim 15 wherein said fluid pump includes an impeller disposed adjacent the opening of said dip tube and adapted to lift fluid through said dip tube and into said pump body.

21. A fluid circulating system as defined in claim 15 wherein said pump is a reciprocating type solenoid pump.

22. A fluid circulating system as defined in claim 15 wherein said pump unit includes a lift impeller adjacent the inlet end of the dip tube and a second impeller disposed in a chamber having a fluid outlet, each of said impellers being driven by a common shaft.

23. A closable storage and transport receptacle for parts washing fluid, said receptacle having a plurality of walls, including one wall adapted to lie adjacent and be supported by a flat working surface, an oppositely directed contoured wall which is adapted to receive and position portions of an associated parts washer sink in nesting relation, first and second pairs of opposed end walls, and a drain opening in said contoured portion to permit entry of fluid, a second spaced apart opening adapted to receive a cleaning fluid dip tube to permit removal of cleaning fluid for recirculation thereof into an associated parts washer, said openings being being provided in the same wall of said receptacle and being relatively closely spaced apart from each other and from one of the end walls of said container so that, in use, when said container is partially filled with fluid and positioned so that said one end wall becomes the top wall thereof, the fluid level in said receptacle will lie below both of said openings, said receptacle further including manually removably closures for said openings to prevent loss of fluid by spilling or evaporation from said container, said container also including, as a part of at least one wall thereof an integrally formed handle to permit transport of said receptacle.

24. A receptacle as defined in claim 23 wherein each of said openings is also defined in part by a generally cylindrical passage having threads on the interior thereof, and wherein said manually removable closures have exterior threads thereon adapted to cooperate with said threads on said receptacle.

25. A receptacle as defined in claim 23 wherein said receptacle further includes, as a part of said oppositely directed contoured wall, a contoured portion adapted to receive and support in nested relation, the housing for a fluid circulating system, said dip tube opening beind disposed within said portion adapted to support said housing.

26. A receptacle as defined in claim 23 wherein said integrally formed handle is formed on the portion of the receptacle which, in use, forms one of the left and right hand sidewalls of said receptacle.

27. A receptacle as defined in claim 23 wherein said integrally formed handle is formed on the portion of the receptacle which, in use, forms one of the front and rear sidewall portions of said receptacle.

28. A receptacle as defined in claim 23 wherein said receptacle further includes at least one undercut portion extending in bottom and joining said contoured wall to an adjacent portion of the container, said undercut portion being adapted to receive and retain a counterpart portion of an associated sink to assist in locking said sink to said receptacle.

29. A receptacle as defined in claim 23 wherein said receptacle further includes additional contoured formations on the margins thereof lying outwardly of said contoured wall, and counterpart formations disposed on the outer margins of said one wall, said formations being constructed and arranged so as to facilitate stacking of a plurality of substantially identical receptacles.

30. A receptacle as defined in claim 23 wherein said one wall adapted to lie adjacent said working surface includes a plurality of bosses extending slightly outwardly of the plane of said one wall, said bosses being adapted for direct engagement of said working surface.

31. A parts washer unit comprising, in combination, a sink unit having side and bottom walls defining a principal portion adapted to receive articles to be washed, a drain opening in a bottom surface thereof, a combination storage and transport receptacle for cleaning fluid, said receptacle being contoured so as to have one portion thereof lie adjacent and be supported by a flat working surface and to have an oppositely directed portion adapted to cooperate with a portion of said sink unit, said receptacle including a drain opening adapted to be positioned in registry with the drain opening in said sink, and a dip tube opening adapted to receive a pump dip tube, and a fluid circulating assembly including a pump and motor unit with said pump having an inlet, an outlet, a dip tube assembly communicating with said pump inlet, and means for directing cleaning fluid to the interior of said principal portion of said sink, said sink, said repceptacle and said circulating assembly being constructed and arranged so as to be received and held in nested, assembled relation within said associated supply and transport receptacle.

32. A parts washer unit as defined in claim 31 wherein said fluid circulating assembly further includes a filter unit forming a part of said means for directing said cleaning fluid, said filter being readily removable and replaceable.

33. A parts washer unit as defined in claim 31 wherein said pump, motor, dip tube, and a portion of said means for directing said cleaning fluid are disposed within a contoured housing, said housing having means for engagement by a portion of said sink, which portions overlie said housing to prevent removal thereof.

34. A parts washer unit as defined in claim 31 wherein said means for insuring that said sink, receptacle and fluid circulating assembly are retained in a fixed position of use, and said openings in said receptacle are constructed and arranged so that said parts washer unit may be stored in a position of use with said oppositely directed portion of said receptacle lying substantially in a vertical plane.

35. A parts washer unit as defined in claim 31 wherein said sink has associated therewith a safety cover having means for supporting said cover in a position to expose the interior of said sink, means urging said cover to a closed position covering the open portion of said sink, with motion of said cover between open and closed positions being controlled by a fusible cover holder unit adapted to melt in case of fire and permit said cover to move to a closed position.

36. A parts washer unit as defined in claim 31 wherein said sink further includes a closable safety cover having its movement controlled by a fusible cover holder, said cover unit comprising a pair of cover panels, one hingedly connected to the other of said panels and the other of said panels being hingedly connected to a portion of said sink.

* * * * *